US009352808B2

(12) United States Patent
Large

(10) Patent No.: US 9,352,808 B2
(45) Date of Patent: May 31, 2016

(54) OFFSHORE PLATFORM HAVING SCR PORCHES MOUNTED ON RISER KEEL GUIDE

(71) Applicant: Seahorse Equipment Corp, Houston, TX (US)

(72) Inventor: Edward Sean Large, Houston, TX (US)

(73) Assignee: Seahorse Equipment Corp, Houston, TX (US)

( * ) Notice: Subject to any disclaimer, the term of this patent is extended or adjusted under 35 U.S.C. 154(b) by 298 days.

(21) Appl. No.: 13/741,577

(22) Filed: Jan. 15, 2013

(65) Prior Publication Data

US 2013/0180443 A1 Jul. 18, 2013

Related U.S. Application Data

(60) Provisional application No. 61/587,001, filed on Jan. 16, 2012.

(51) Int. Cl.

| | |
|---|---|
| ***B63B 35/44*** | (2006.01) |
| ***B63B 1/10*** | (2006.01) |
| ***B63B 1/04*** | (2006.01) |
| ***E21B 19/00*** | (2006.01) |
| *B63B 1/12* | (2006.01) |

(52) U.S. Cl.

CPC ..... *B63B 35/4413* (2013.01); *B63B 1/04* (2013.01); *B63B 1/107* (2013.01); *B63B 35/44* (2013.01); *E21B 19/004* (2013.01); *B63B 2001/044* (2013.01); *B63B 2001/128* (2013.01); *B63B 2241/12* (2013.01)

(58) Field of Classification Search

CPC ..... B63B 35/44; B63B 1/107; B63B 1/104; B63B 2001/044; B63B 2001/128; B63B 2241/12; B63B 35/4413; B63B 2035/448; E21B 19/004

USPC ..... 114/264, 265; 405/195.1, 223.1–224.4

See application file for complete search history.

(56) References Cited

U.S. PATENT DOCUMENTS

| | | | | |
|---|---|---|---|---|
| 4,198,179 | A * | 4/1980 | Pease et al. | 405/224.2 |
| 4,848,970 | A | 7/1989 | Hunter et al. | |
| 5,150,987 | A * | 9/1992 | White et al. | 405/224 |
| 5,439,321 | A * | 8/1995 | Hunter | 405/195.1 |
| 6,447,208 | B1 | 9/2002 | Huang et al. | |
| 6,739,804 | B1 | 5/2004 | Haun | |
| 6,997,132 | B2 * | 2/2006 | Steen | 114/265 |
| 7,462,000 | B2 | 12/2008 | Leverette et al. | |
| 7,537,416 | B2 * | 5/2009 | Wetch | 405/224.2 |
| 7,914,234 | B2 | 3/2011 | Large et al. | |
| 8,267,032 | B2 * | 9/2012 | Zou | 114/266 |
| 8,418,640 | B2 * | 4/2013 | Leverette | 114/264 |
| 8,550,171 | B2 | 10/2013 | Wajnikonis et al. | |

(Continued)

FOREIGN PATENT DOCUMENTS

WO 2008/019067 A2 2/2008

*Primary Examiner* — Ajay Vasudeva

(74) *Attorney, Agent, or Firm* — Blank Rome LLP

(57) ABSTRACT

A floating, offshore drilling and/or production vessel has supports for steel catenary risers mounted on a riser keel guide. This allows the riser attachment points to be located closer to the vessel's center(s) of rotation of pitch, roll and yaw thereby decreasing roll-, pitch- and yaw-induced displacements of the risers.

12 Claims, 3 Drawing Sheets

(56) References Cited

U.S. PATENT DOCUMENTS

| | | | | |
|---|---|---|---|---|
| 8,689,882 | B2 | 4/2014 | Wajnikonis et al. | |
| 8,707,882 | B2 | 4/2014 | Rijken et al. | |
| 8,757,082 | B2 | 6/2014 | Rijken et al. | |
| 8,807,874 | B2 * | 8/2014 | Zeng et al. | 405/224.4 |
| 2004/0182297 | A1 * | 9/2004 | Wybro et al. | 114/230.1 |
| 2008/0031692 | A1 * | 2/2008 | Wybro et al. | 405/224.4 |
| 2010/0074693 | A1 | 3/2010 | Leverette et al. | |
| 2013/0098627 | A1 | 4/2013 | Jordan et al. | |

* cited by examiner

OFFSHORE PLATFORM HAVING SCR PORCHES MOUNTED ON RISER KEEL GUIDE

CROSS-REFERENCE TO RELATED APPLICATIONS

This application claims the benefit of U.S. Provisional Application No. 61/587,001 filed on Jan. 16, 2012.

STATEMENT REGARDING FEDERALLY SPONSORED RESEARCH OR DEVELOPMENT

Not Applicable

BACKGROUND OF THE INVENTION

1. Field of the Invention

This invention relates to floating offshore platforms. More particularly, it relates to offshore platforms having steel catenary risers attached thereto.

2. Description of the Related Art Including Information Disclosed Under 37 CFR 1.97 and 1.98

A semi-submersible is an offshore, floating unit, with its deck supported by columns to enable the unit to become almost transparent for waves and provide favorable motion behavior. The unit stays on location using dynamic positioning and/or is anchored by means of catenary mooring lines terminating in piles or anchors.

A tension leg platform is a floating production platform positioned and stabilized by at least three separated, vertical tendons anchored to the seabed. The tendons are tensioned using the buoyancy of the underwater hull of the platform. Subjected to wave, wind and current action, the platform moves sideways, but remains horizontal due to the parallel actions of the tendons. The vertical motion (heave) is eliminated and the facility is therefore suitable for surface completion of the wells.

Both tension leg platforms (TLP's) and semi-submersible floating vessels ("semis") may be used for offshore drilling and production operations.

A Steel Catenary Riser (SCR) is a steel pipe hung in a catenary configuration from a floating vessel in deep water (such as a TLP or semi) to transmit flow to or from the sea floor.

Attachment points on the floating vessel for Steel Catenary Risers ("riser porches") are typically located at or near the outer perimeter of tension leg and semisubmersible platforms, on the outboard side shell of the base structure pontoons. As such, they are susceptible to the global motions of the platforms, creating long-term fatigue damage which is often the governing criteria in the design of SCR components. While global heave, surge and sway translate directly into relative linear motions at the SCR porches, the net displacements may be amplified by rotational pitch and roll, and to a lesser extent, by yaw motions, based on the radial distance with respect to the center(s) of global rotation. Reducing this distance may lower the roll/pitch-induced displacement, and thereby reduce cumulative fatigue damage in the SCR components. Thus, the closer the SCR porch can be attached to the center of global roll and pitch rotation of the supporting vessel, the longer the fatigue life may be extended.

Cost comparisons indicate a significant economic advantage in the dry-tree platform, on-board drilling approach with respect to comparable tender drilling, wet-tree designs. However, in order to produce a functional, efficient Top Tensioned Riser system, while maintaining stroke within the range of existing hardware, some form of riser keel guide is often required. This applies not only to vessels having a battered-column hull, (e.g., as disclosed in U.S. Pat. No. 7,462,000 to Leverette et al. entitled: "Battered column tension leg platform") but to conventional, vertical-column semi-submersibles and TLPs. The keel guide is typically designed to carry only the dominant lateral loads of the riser array, as well as some consequential friction and inertial loading. However, the deep box-section guide structure described herein may easily accommodate the additional loading of SCR porches, located as far inboard as required to reduce the amount of accumulated fatigue damage to acceptable levels. While it was designed to span a much greater distance than in the typical platform, and modified to effect a change in platform dynamics, the basic design of the structure is easily adaptable to all Semi-Submersible and TLP designs. The concept may thus provide a level of dynamic loading reduction, and thereby comparable SCR fatigue life extension for all applicable platform types.

BRIEF SUMMARY OF THE INVENTION

A floating, offshore drilling and/or production vessel has supports for steel catenary risers mounted on a riser keel guide. This allows the riser attachment points to be located closer to the vessel's center(s) of rotation for pitch, roll and yaw thereby decreasing roll-, pitch- and yaw-induced displacements.

The present invention provides a means of supporting SCR porches at locations well inboard of the normal pontoon side shells in order to reduce motion due to platform roll and pitch.

A design for a keel-level structure according to the invention may be built according to normal stiffened plate strength and buckling design criteria, and thus be incorporated cleanly into the existing framing of the pontoons.

A vessel according to the invention may comprise a structure spanning the distance between inboard faces of opposing pontoons, that is designed and arranged to accommodate both guide funnels for top tensioned risers and porch receptacles for steel catenary risers and umbilical lines.

A structure according to the invention may comprise an open box structure which also serves to add a predetermined amount of effective water mass to the platform, in order to adjust system dynamic characteristics to suit the operating environment.

BRIEF DESCRIPTION OF THE SEVERAL VIEWS OF THE DRAWING(S)

DETAILED DESCRIPTION OF THE INVENTION

Figure 1:
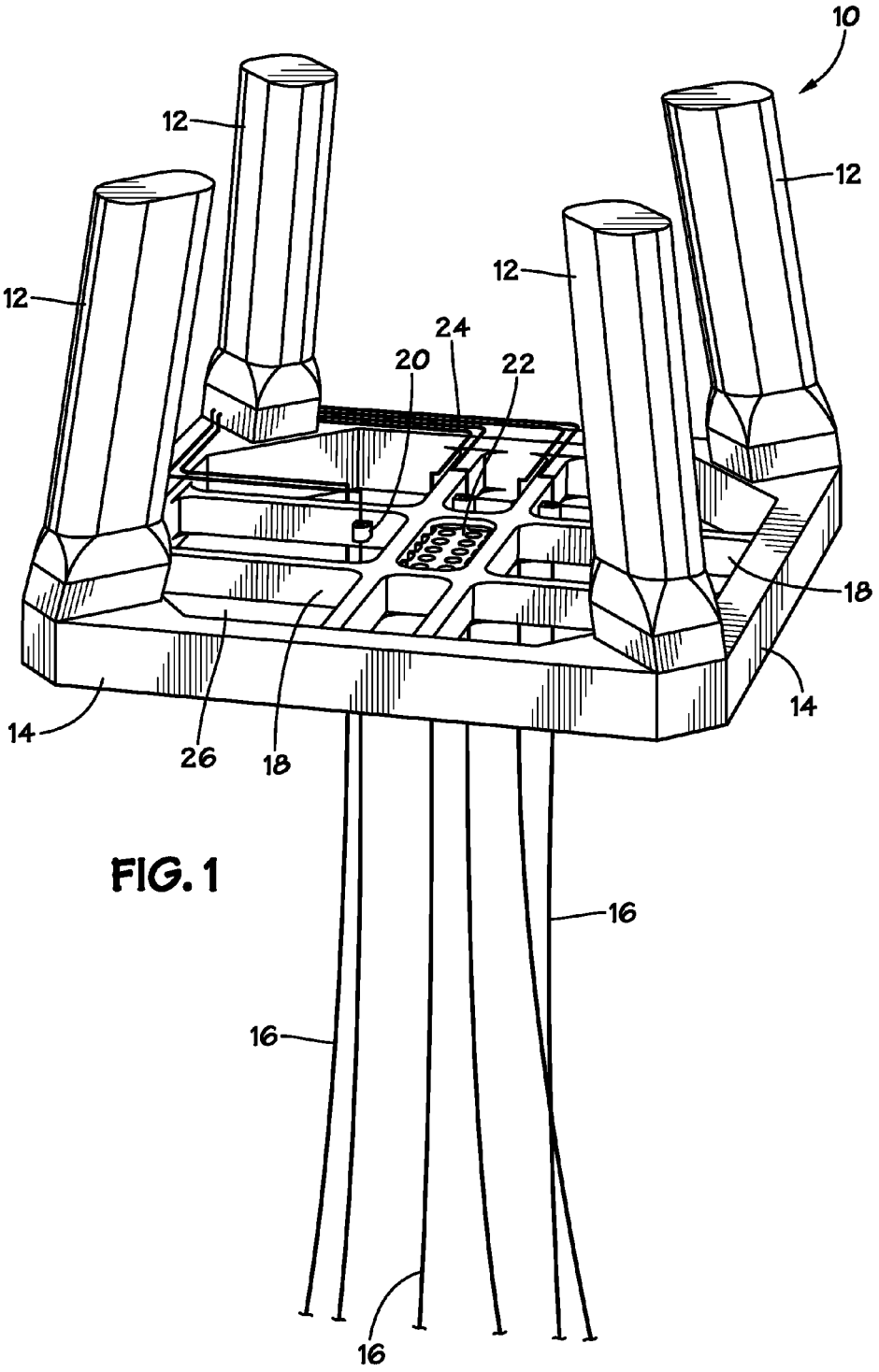
FIG. 1 is a side isometric view of a battered-column, dry-tree, semi-submersible hull having a riser keel guide with a plurality of steel catenary risers attached thereto.

The invention may best be understood by reference to the exemplary embodiment(s) illustrated in the drawing figures. The drawing figures illustrate the base structure of a dry-tree semi-submersible (in isometric and plan views) showing the columns, pontoons, and keel guide structure, as well as exemplary flowline and/or umbilical routing and porch locations.

In 2010, a battered-column, dry-tree semisubmersible platform was developed for the Gulf of Mexico and similar cyclonic environments. The platform incorporated a rigid, robust keel structure, spanning between the inboard faces of the pontoons, and designed to be incorporated cleanly and efficiently into the existing pontoon framing. The structure served the dual purpose of supporting the guide funnels for the top-tensioned risers (TTRs), while "capturing" a sufficient amount of water mass to effect a change in the heave characteristics of the platform. This was required in order to provide the desired life to the perimeter-mounted SCRs, while limiting the stroke of the Top Tensioned Risers [riser tensioners] to acceptable levels. The hull and keel guide of this particular design are illustrated in the drawing figures. It will be appreciated by those skilled in the art that the present invention may be applied to other hull designs.

Platform dynamics are often the governing factor in the location of and hardware design for perimeter-mounted steel catenary risers. Initial global analyses and platform sizing often focus on tweaking the Range Amplitude Operators (RAOs) so as to avoid the high-energy, high-response sectors of the metocean environment. Thus, other platform global characteristics (such as displacement and ballasting requirements) often become the results of (rather than the inputs to) the sizing exercises.

To reduce the motions of the SCRs, specifically those induced by roll and pitch of the vessel, a means of mounting the porches farther inboard may be beneficial. Where a centralized guide structure for the lateral constraint of top tensioned risers at the keel level is required, said structure may be reinforced in order to carry the additional loads imposed by import/export SCRs and umbilical lines. For both strength and added water mass purposes, where adjustment to global dynamics is demanded or desired, it may be designed as a stiffened-plate, deep box, open section, rather than the typical tubular space frame or wide-flange girder structure. The typical internal stiffening frames of the open box section may then be adapted for use as back-up for attachment of SCR and umbilical porches.

The device described herein provides:

A means of supporting SCR porches at locations well inboard of the normal pontoon side shells in order to reduce motion due to platform roll and pitch;

A design for a keel-level structure which may be built according to normal stiffened plate strength and buckling design criteria, and thus incorporated cleanly into the existing framing of the pontoons;

A structure spanning the distance between inboard faces of opposing pontoons, designed and arranged to accommodate both guide funnels for top tensioned risers, and porch receptacles for steel catenary risers and umbilical lines; and, An open box structure which also serves to add a predetermined amount of effective water mass to the platform, in order to adjust system dynamic characteristics to suit the operating environment.

Figure 2:
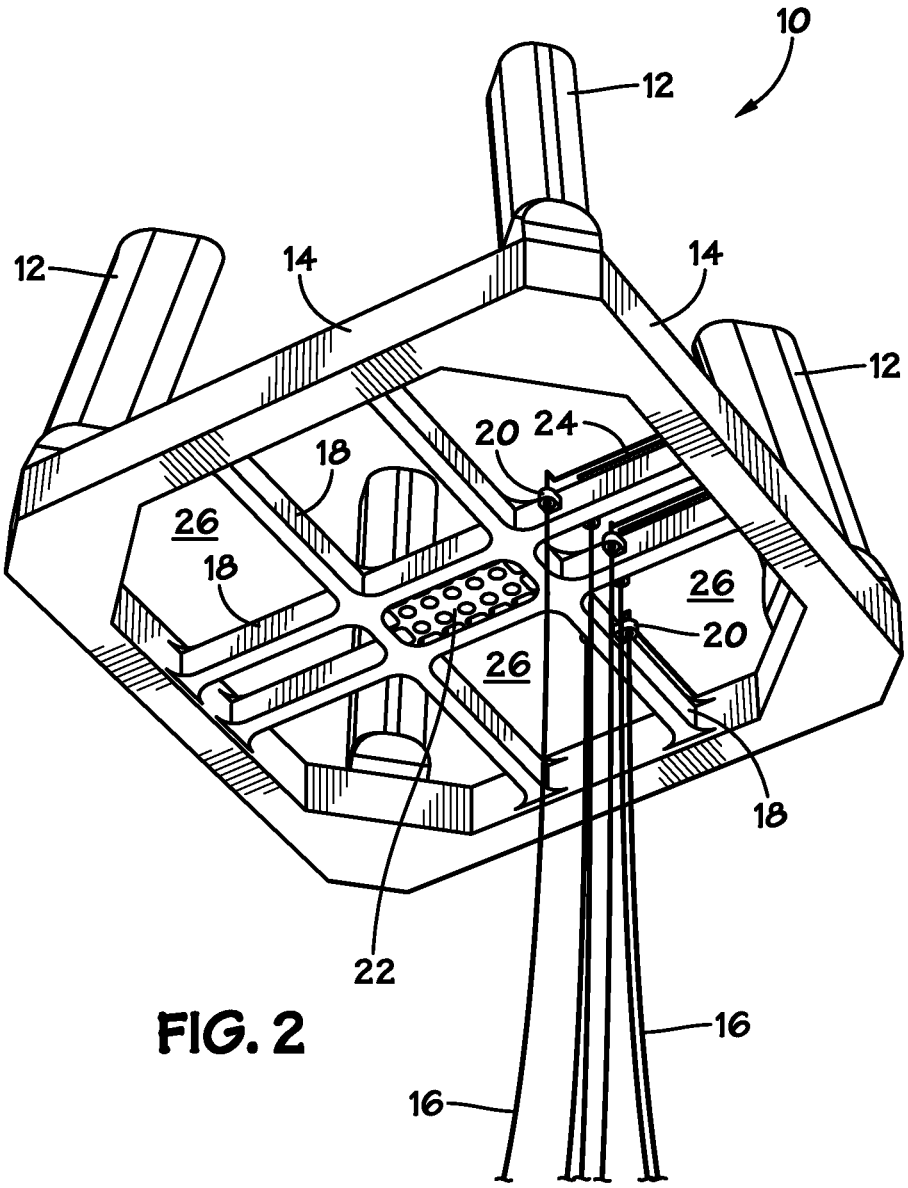
FIG. 2 is a bottom isometric view of a battered-column, dry-tree, semi-submersible hull having a riser keel guide with a plurality of steel catenary risers attached thereto.
Figure 3:
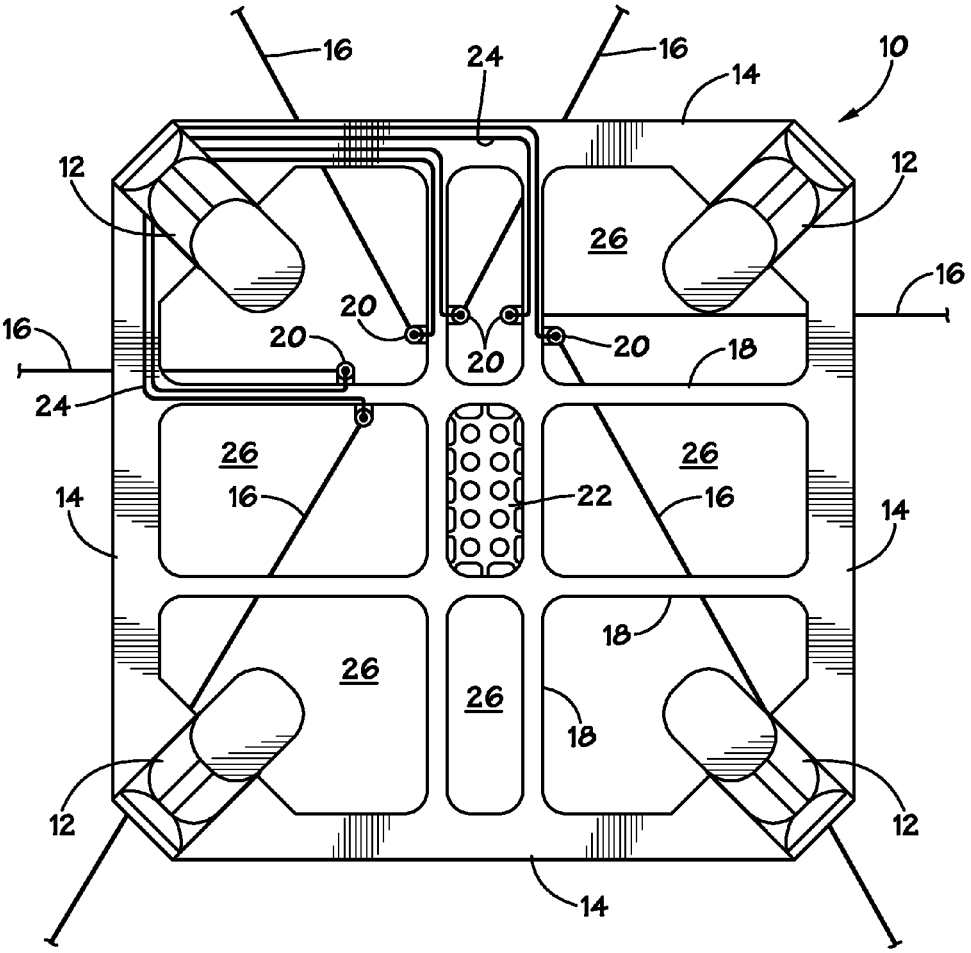
FIG. 3 is a top plan view of a battered-column, dry-tree, semi-submersible hull having four columns arranged in a generally square configuration and a riser keel guide with a plurality of steel catenary risers attached thereto.

Referring now to FIGS. 1, 2 and 3, offshore platform hull 10 comprises surface-piercing columns 12 mounted on subsurface pontoon ring 14. In the illustrated embodiment, columns 12 are battered columns. It should be appreciated, however, that the present invention may be practiced using platform hulls having other types of columns including, but not limited to, vertical columns. Hull 10 may be the hull of a semi-submersible vessel or the hull of a tension leg platform.

Hull 10 has keel guide 18 which comprises a plurality of intersecting beams connecting opposing, inboard faces of pontoons 14. The beams define a plurality of openings 26 through which subsea risers (and/or umbilical lines) 16 may enter. The subsea risers may be steel catenary risers (SCRs) that are in fluid communication with wellheads on the seafloor.

Porches 20 (which may be SCR porches and/or porches for umbilical lines) may be mounted to the substantially vertical sides of the beams which comprise keel guide 18. Piping 24 is in fluid communication with the risers and may be in fluid communication with petroleum processing equipment or the like on a platform deck (not shown) supported on columns 12. In certain embodiments, lines 24 may comprise umbilical lines.

Keel guide 18 may also support funnel array 22 for spacing and limiting the lateral motion of top-tensioned vertical risers (not shown) which may connect subsea wells to dry trees on a production deck (not shown) supported on columns 12.

The beams which comprise keel guide 18 may be incorporated into the conventional framing of pontoons 14. Keel guide 18 may comprise an open box structure which also serves to add a certain amount of effective water mass to the platform.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A floating, offshore platform comprising:

at least four surface-piercing columns at the outer perimeter of the platform arranged in a generally rectangular configuration;

a first pontoon connected between a first pair of adjacent ones of said columns;

a second pontoon, opposite said first pontoon and connected between a second pair of adjacent ones of said columns;

a first support structure connected at a first end thereof to the first pontoon and connected at a second end thereof to the second pontoon;

a second support structure connected at a first end thereof to the first pontoon and connected at a second end thereof to the second pontoon, said second support structure spaced apart from and generally parallel to the first support structure;

an array comprising a plurality of guide funnels configured for top tensioned vertical risers said array supported by and between the first support structure and the second support structure; and, a porch configured to support an upper end of a subsea catenary riser and attached to the first support structure at a location displaced from both the first pontoon and the second pontoon.

2. A floating, offshore platform as recited in claim 1 wherein the columns are arranged in a generally square configuration.

3. A floating, offshore platform as recited in claim 1 wherein the columns are battered columns.

4. A floating, offshore platform as recited in claim 1 wherein the platform comprises a semi-submersible vessel.

5. A floating, offshore platform as recited in claim 1 wherein the platform comprises a tension leg platform.

6. A floating, offshore platform as recited in claim 1 wherein the porch configured to support the upper end of a catenary riser is configured to support the upper end of a steel catenary riser.

7. A floating, offshore platform as recited in claim 1 wherein the porch configured to support the upper end of a riser is configured to support an umbilical line.

8. A floating, offshore platform as recited in claim 1 wherein the first support structure and second support structure are incorporated into the framing of the pontoons to which they are connected.

9. A floating, offshore platform as recited in claim 1 further comprising piping supported at least in part on the first support structure and in fluid communication with a riser supported on the porch.

10. A floating, offshore platform as recited in claim 9 wherein the piping is in fluid communication with petroleum processing equipment on the offshore platform.

11. A floating, offshore platform as recited in claim 1 wherein the porch attached to the first support structure is attached at a location that is closer to the central, vertical axis of the vessel than to the lateral perimeter of the vessel.

12. A floating, offshore platform as recited in claim 1 wherein the first support structure and the second support structure comprise an open box structure which also serves to add a certain amount of effective water mass to the platform.

* * * * *